US009636913B2

(12) United States Patent
Clark

(10) Patent No.: US 9,636,913 B2
(45) Date of Patent: May 2, 2017

(54) NOZZLE EJECTION TRAJECTORY DETECTION

(75) Inventor: Stephan R. Clark, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/373,962

(22) PCT Filed: Apr. 9, 2012

(86) PCT No.: PCT/US2012/032816

§ 371 (c)(1),
(2), (4) Date: Jul. 23, 2014

(87) PCT Pub. No.: WO2013/154530

PCT Pub. Date: Oct. 17, 2013

(65) Prior Publication Data

US 2014/0347420 A1 Nov. 27, 2014

(51) Int. Cl.

| | |
|---|---|
| ***B41J 29/393*** | (2006.01) |
| ***B41J 2/125*** | (2006.01) |
| ***B41J 2/12*** | (2006.01) |
| ***B41J 2/21*** | (2006.01) |

(52) U.S. Cl.
CPC ..... *B41J 2/125* (2013.01); *B41J 2/12* (2013.01); *B41J 2/2142* (2013.01)

(58) Field of Classification Search
USPC ..... 347/12, 14, 15, 19, 23
See application file for complete search history.

(56) References Cited

U.S. PATENT DOCUMENTS

| | | | | |
|---|---|---|---|---|
| 3,886,564 | A | 5/1975 | Naylor et al. | |
| 4,344,078 | A | 8/1982 | Houston | |
| 4,540,990 | A | 9/1985 | Crean | |
| 4,990,932 | A | 2/1991 | Houston | |
| 6,568,786 | B2 | 5/2003 | Sarmast et al. | |
| 6,767,088 | B2 | 7/2004 | Sarmast | |
| 7,963,627 | B2 * | 6/2011 | Ito | B41J 2/0451 347/19 |
| 8,376,506 | B2 * | 2/2013 | Shepherd | B41J 29/393 347/19 |
| 2002/0105629 | A1 | 8/2002 | Sandstrom et al. | |
| 2005/0073544 | A1 | 4/2005 | Scofield | |
| 2006/0192845 | A1 | 8/2006 | Cordingley et al. | |
| 2007/0024658 | A1 | 2/2007 | Diol et al. | |

(Continued)

FOREIGN PATENT DOCUMENTS

| | | |
|---|---|---|
| CN | 1509879 | 7/2004 |
| CN | 1532052 | 9/2004 |

(Continued)

OTHER PUBLICATIONS

International Search Report. Date of mailing Aug. 13, 2013. International application No. PCT/US2012/032816.

(Continued)

*Primary Examiner* — Lam Nguyen
(74) *Attorney, Agent, or Firm* — Rathe Lindenbaum LLP

(57) ABSTRACT

Light redirected by liquid droplets ejected from nozzles (30) of a plurality of columns (26, 226, 227) of nozzles (30) is sensed to detect a vertical trajectory of the liquid droplets for each of the nozzles (30).

20 Claims, 7 Drawing Sheets

(56) References Cited

U.S. PATENT DOCUMENTS

| | | | | |
|---|---|---|---|---|
| 2007/0070175 | A1 | 3/2007 | Van Brocklin et al. | |
| 2008/0101198 | A1 | 5/2008 | Van Brocklin et al. | |
| 2009/0096826 | A1* | 4/2009 | Hayashi | 347/14 |
| 2010/0020122 | A1 | 1/2010 | Lee et al. | |
| 2010/0207989 | A1 | 8/2010 | Govyadinov | |

FOREIGN PATENT DOCUMENTS

| | | |
|---|---|---|
| CN | 1907708 | 2/2007 |
| CN | 101164785 | 4/2008 |
| CN | 101622134 | 1/2010 |
| JP | 2006007445 | 1/2006 |

OTHER PUBLICATIONS

European Patent Office. Extended European Search Report. Date of mailing Aug. 6, 2015. Application No. EP12874151.9/2836366. PCT/US2012/032816.

* cited by examiner

NOZZLE EJECTION TRAJECTORY DETECTION

BACKGROUND

Printers sometimes form images by firing droplets of ink onto a print medium. Vertical trajectories of such ink drops may be error-prone, reducing quality of the printed image. Detecting such vertical trajectory errors so that they may be addressed is frequently costly and slow for large nozzle count printers.

DETAILED DESCRIPTION OF THE EXAMPLE EMBODIMENTS

Figure 1:
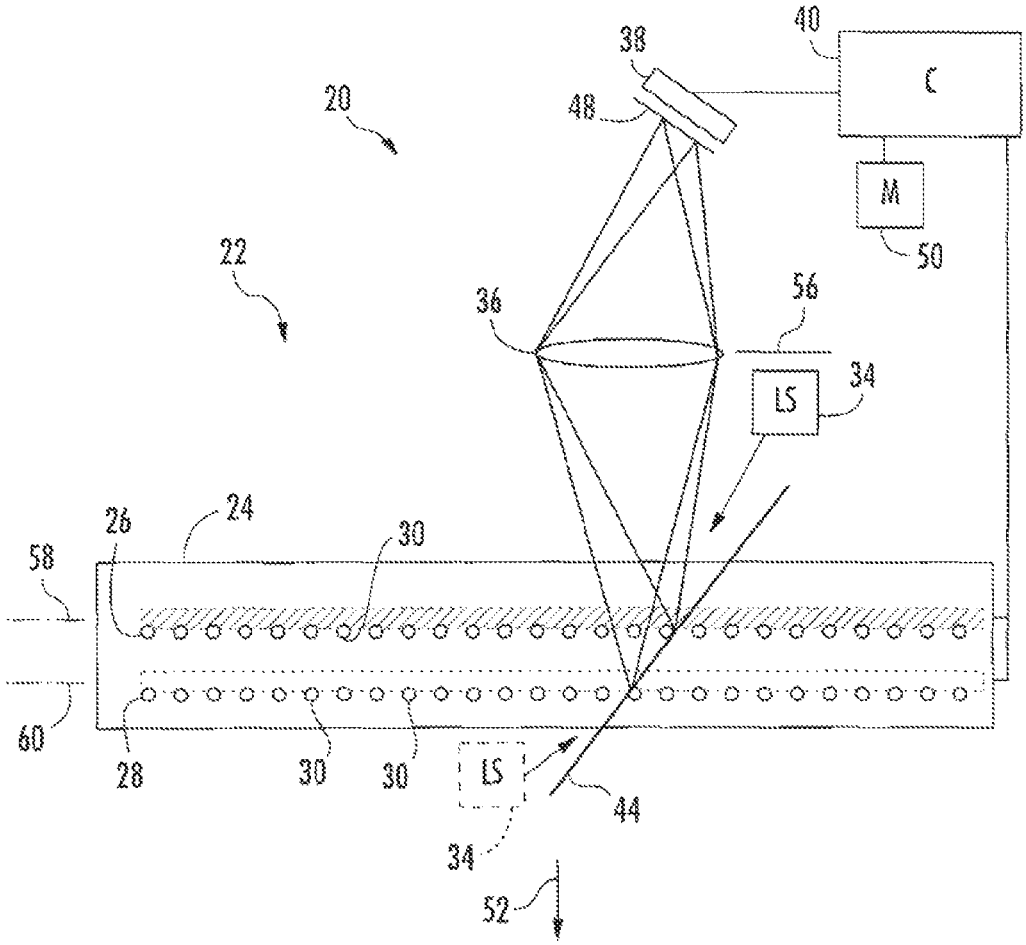
FIG. 1 is a schematic illustration of an example printing system including an example nozzle ejection trajectory detection system.

FIG. 1 schematically illustrates an example nozzle ejection trajectory detection system 20. As will be described hereafter, system 20 detects a vertical trajectory or vertical path of liquid droplets or drops as the droplets or drops are falling or moving away from a nozzle opening. System 20 detects errors in such vertical trajectories or vertical paths in a less costly and less time-consuming manner, allowing larger numbers or arrays of nozzles to be efficiently evaluated and possibly corrected for enhanced print image quality.

FIG. 1 schematically illustrates system 20 being utilized as part of a printer or printing device 22 which includes print head 24 comprising columns 26, 28 of nozzles 30. Nozzles 30 are arranging columns 26, 28 and eject liquid, such as ink, onto a print medium. Such ink or other liquid is deposited so as to form a pattern or image upon a print medium or substrate. In one implementation, nozzles 30 comprise thermoresistive inkjet nozzles. In another implementation, nozzles 30 comprise piezoresistive ink jet nozzles. In yet other implementations, nozzles 30 may comprise openings through which the liquid or ink is ejected under the force of other liquid ejection driving or drop-on-demand printing mechanisms.

System 20 detects a vertical trajectory or vertical path of liquid ejected through a nozzle 30 in each of columns 26 and 28 during a single focal state. In other words, system 20 detects the vertical trajectory of two separate nozzles in two separate columns on print head 24 during a single focal state of system 20, and nominally ejected or fired at the same time, to reduce the overall time consumed for detecting a performance of multiple nozzles in multiple columns. System 20 comprises a light source 34, lens 36, sensor 38 and controller 40.

Light source 34 comprises a source of light that directs light across both columns 26 and 28 of nozzles 30 below nozzles 30. The light provided by light source 34 is at least partially redirected by the liquid droplets through such optical phenomena as light scattering and the like. As will be described hereafter, the redirected light from such liquid droplets is subsequently focused and sensed to determine the vertical trajectory or vertical path of the liquid droplets. In one implementation, light source 34 comprises one or more infrared light emitting diodes that emit light of a wavelength of about 850 nm. In such an implementation, light source 34 directs or emits light in a direction slightly offset from object plane 44, less than 10 degrees offset from object plane 44. As a result, a power density of the light emitted by light source 34 may be relatively low while also providing sufficient light scattering or light reflection from the ejected liquid droplets for trajectory detection. In other implementations, where light source 34 provides a greater power density, light source 34 may be provided at other locations and may emit light in other directions with other angular divergence characteristics. For example, light source 34 may alternatively be provided at the location shown in broken lines in FIG. 1. In other implementations, light source 34 may direct light down the lines of each of columns 26, 28.

Lens 36 comprises an optical device supported between print head 24 and sensor 38 at an angle and spacing so as to capture and redirect or focus light redirected from the falling liquid droplets onto a detection or image plane 48 of sensor 38. Although illustrated as a biconvex lens, in other implementations, lens 36 may comprise other types of lenses such as a plano-convex lens or a multi-lenses setup may also be used. As will be described hereafter, lens 36 is situated so as to cooperate with object plane 44 and image plane 48 to focus light redirected from liquid droplets ejected from nozzles 30 across multiple columns 26, 28 onto image plane 48 while lens 36 is in a single focal state. In other words, lens 36 is utilized to focus light onto sensor 38 to detect vertical trajectories of ink droplets from multiple spaced columns of nozzles without adjustment or movement of a focal state of lens 36 and/or sensor 38.

Sensor 38 comprises one or more sensors sized and located to be impinged by electromagnetic radiation in the form of light (ultraviolet light, infrared light or visible light) redirected by falling liquid droplets from nozzles 30 and focused or directed by lens 36 onto imaging plane 48 of sensor 38. In one implementation, sensor 38 comprises a two-dimensional array of sensing elements, such as charge coupled elements. For example, in one implementation, sensor 38 may comprise an array of 512×512 charge coupled devices. In another implementation, sensor 38 may comprise two or a pair of offset linear arrays of sensing elements. For example, in one implementation, sensor 38 may comprise a first row of sensing elements and a second row of sensing elements spaced from the first row so as to sense a first upper portion of a vertical trajectory of liquid droplets and to also sense a second lower portion of the vertical trajectory of liquid droplets. In one implementation, sensor 38 may comprise a first row of 512 charge coupled sensing elements and a second row of 512 charge coupled sensing elements.

Sensor 38 has a density of sensing elements so as to provide a sensing element or sensing pixel resolution of at least two, and nominally at least three, sensing elements or sensing pixels for each liquid droplet. In other words, light redirected from each liquid droplet that impinges sensor 38 has a size at least twice as large and nominally at least three times as large in horizontal width as an individual sensing element or sensing pixel of sensor 38. As a result, sensor 38 may be better adapted to more precisely sense variations in a vertical trajectory of a liquid droplet from a particular nozzle 30. In one implementation, sensor 38 has a length of about 3 mm and a height of about 2 mm. In other implementations, sensor 38 may comprise other arrangements of sensing elements and may have different densities or resolutions for such sensing elements.

Controller 40 comprises one or more processing units that generate control signals directing the firing or ejection of liquid droplets from nozzles 30. Controller 40 further receives signals from sensor 38 indicating vertical trajectories or paths of the ejected liquid droplets from the nozzles 30. Controller 40 may then utilize the detected vertical trajectories or paths to either display or otherwise providing notification that print head 24 is malfunctioning or may need to be repaired or replaced, or adjust the timing at which nozzles 30 are fired with respect to movement of the print media to accommodate or address the detected vertical directories of particular nozzles 34 or to fire different nozzles to compensate for the misfiring of the initial nozzles.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 40 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example implementation illustrated, controller 40 performs such functions following instructions contained in memory 50. Memory 50 comprises a non-transient computer-readable medium which includes or stores computer-readable code or computer-readable programming directing the operation of controller 40. The code or instructions stored in memory 40 and read by controller 40 cause system 20 to carry out the example vertical trajectory detection method 100 shown in FIG. 2.

Figure 2:
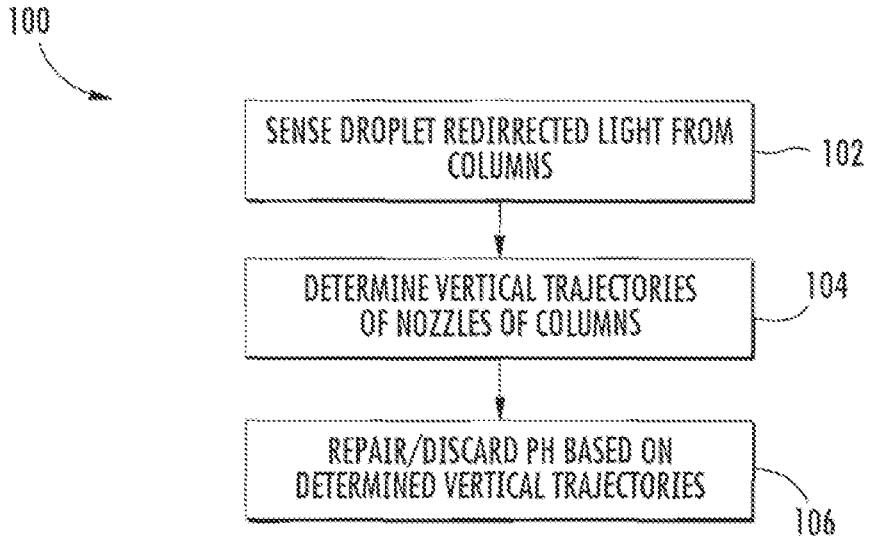
FIG. 2 is a flow diagram of an example method that may be carried out by the printing system of FIG. 1.

As indicated by step 102 in FIG. 2, droplet redirected light concurrently ejected from a nozzle 30 in each of columns 26 and 28 is sensed. In the example illustrated, controller 40, following instructions contained in memory 50, generates control signals directing a nozzle in each of columns 26 and 28 to eject an associated liquid droplet. In one implementation, the ejected liquid droplet may be captured by a spittoon, an absorbent member or a print medium. Controller 40 generates control signals such that the nozzles 30 in each of columns 26 and 28 and from which the liquid droplets are ejected are offset from one another in a direction along the axes of columns 26 and 28 so as to be located or lie generally along the object plane 44 (sometimes referred to as a plane of focus). The distance or spacing offsetting the first and second closest nozzles 30 of columns 26 and 28, respectively, is such that two spots are formed upon sensor 38 by light redirected from the liquid droplets ejected from the first and second nozzles 30 of columns 26 and 28 and wherein such spots do not overlap one another on image plane 48 of sensor 38. In one implementation, the two nozzles 30 of columns 26 and 28 lie directly on object plane 44. In other implementations, the two nozzles of columns 26 and 28 may be offset or slightly spaced from object plane 44 so long as the spots formed by light redirected from the droplets ejected from the nozzles 30 may be concurrently detected by sensor 38. For example, in one implementation, nozzle 30 of column 26 may lie to the right (as seen in FIG. 1) of object plane 44 while the other nozzle 30 of column 28 lies to the left of object plane 44.

As shown by FIG. 1, object plane 44 is tilted or oblique with respect to a print media travel direction as indicated by arrow 52. Likewise, the image or detection plane 48 is tilted with respect to or oblique with respect to the axes of columns 26, 28, the media travel direction as indicated by arrow 52, object plane 44 and the plane 56 along which lens 36 extends. Although lens plane 56 is illustrated as being substantially parallel to the axes of columns 26, 28, in other implementations, planes 36 may be angularly offset or oblique with respect to the axes of columns 26, 28.

Because the plane along which liquid droplets are fired from nozzles 30 of multiple columns 26, 28 is tilted or oblique with respect the axes 58, 60 of columns 26, 28 and because the image or detection plane of sensor 38 is also tilted or oblique with respect to the axes 58, 60 of columns 26, 28 in general accordance with the Scheimpflug principle, lens 36 and sensor 38 achieve a greater depth of focus or depth of field, able to adequately detect vertical trajectories or paths of liquid droplets from nozzles 30 in different columns 26, 28 while system 20 is in a single a focal state. In other words, the arrangement of system 20 facilitates vertical trajectory detection from nozzles of multiple nozzle columns without having to refocus for the different nozzles of the different columns. Because lens 36 and sensor 38 in conjunction with the tilted object plane 44 provide a greater depth of field facilitating detection of liquid droplet trajectories from multiple columns without focal adjustments for detecting trajectories of nozzles from such different columns, system 20 may detect vertical trajectories of liquid droplets at a greater rate with such liquid droplet being ejected at closer points in time. In one implementation, system 20 may detect vertical trajectories of liquid droplets concurrently ejected from nozzles 30 located in different columns for even faster overall detection times. In such an implementation, vertical trajectory measurements may be multiplexed to increase detection speed of system 20. Because refocusing for each of multiple nozzle columns may be avoided, system 20 may have a less complex mechanical layout with a relatively small size for lens 36 and sensor 38.

In the example implementation illustrated, nozzles 30 extend along the axes 58, 60 of columns 26, 28, respectively. The nozzles 30 that are concurrently fired extend along an object plane that extends between 35 degrees and 55 degrees with respect to axes 58, 60, and nominally about 45 degrees. For purposes of this disclosure, such angles are to be measured with respect to a plane that most closely intersects or bisects a first nozzle 30 in the first column 26 and a second nozzle 30 in a second column 28, wherein the plane either coincides with both nozzles or is located such that the first nozzle 30 is on a first side of the plane and the second nozzle 30 is on a second side of the plane. In other implementations, the angular orientation of object plane 44 may be tilted at other angles with respect to the axes of the columns of nozzles 30.

As indicated by step 104 of method 100 in FIG. 2, once the droplet redirected light from the columns 58, 60 is sensed by sensor 38 and corresponding signals are transmitted to controller 40, controller 40, following instructions contained in memory 50, determines a vertical trajectory of each of the ink droplets from the nozzles 30 of the different columns 58, 60. This may be accomplished by evaluating the spots upon image plane 48 of sensor 48 upon which the light redirected from the liquid droplets impinges sensor 38. As indicated by step 106, based upon the determined vertical trajectories of the ink droplets from the nozzles of the different columns, controller 40 may display or otherwise provide a notification of whether print head 40 should be repaired or discarded and replaced. Such evaluation may be carried out during manufacture of the printing system as part of a quality control program.

Figure 3:
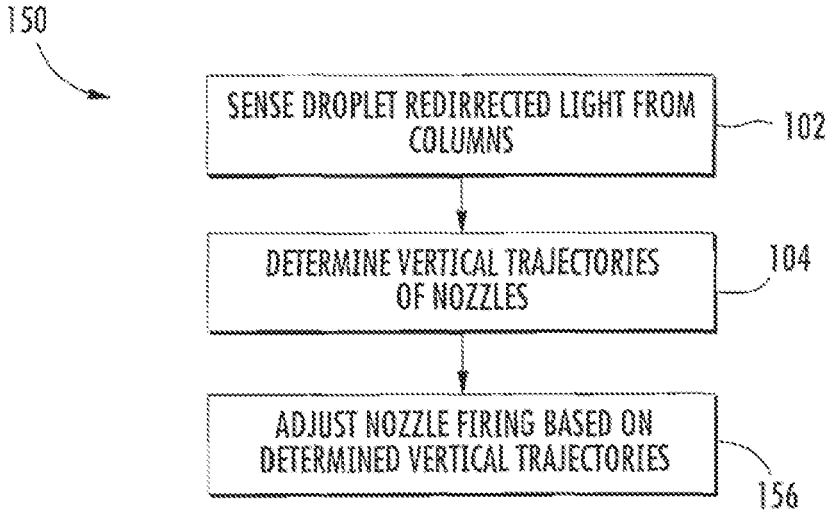
FIG. 3 is a flow diagram of another example method that may be carried out by the printing system of FIG. 1.
Figure 4:
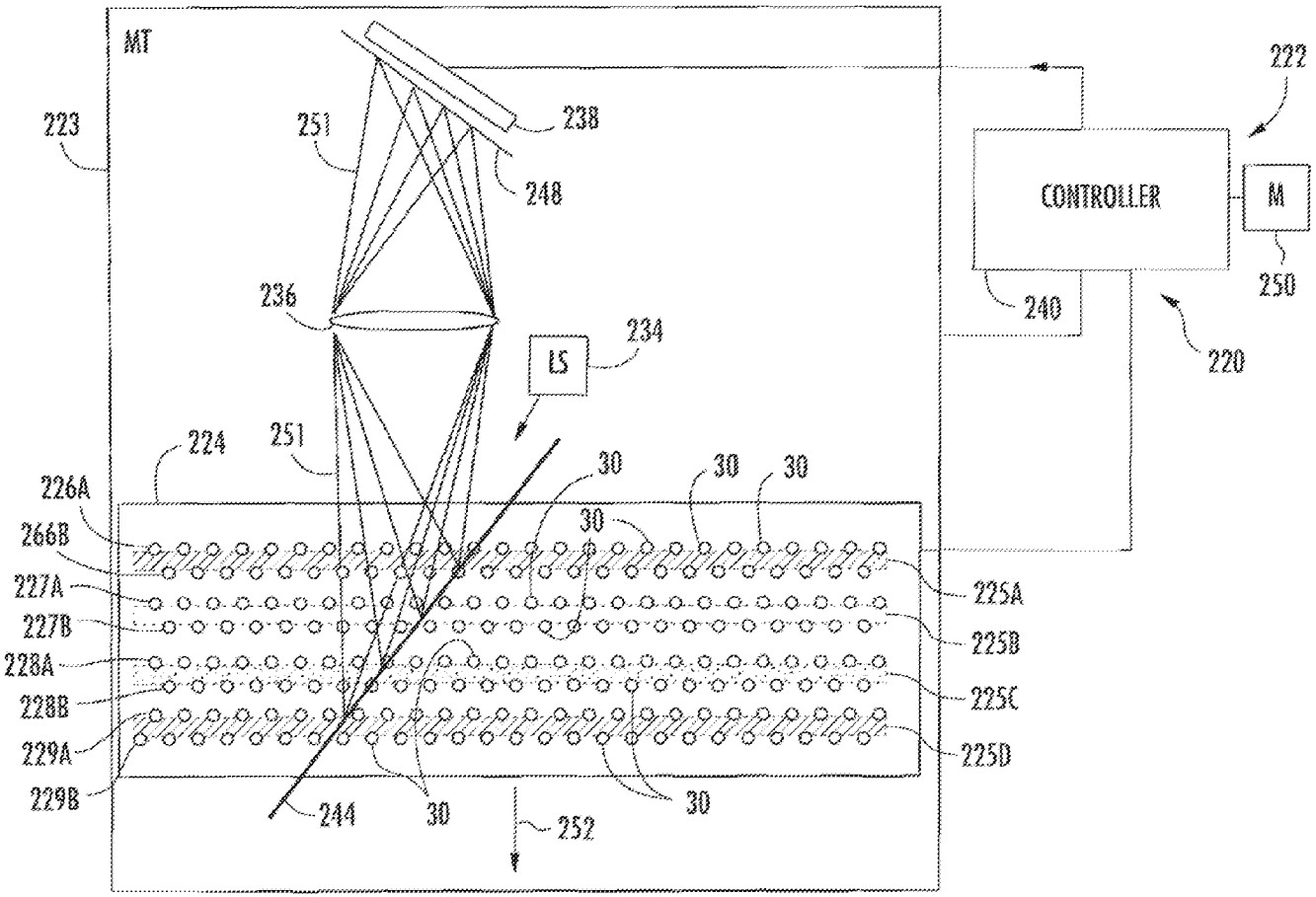
FIG. 4 is a schematic illustration of an example implementation of the printing system of FIG. 1.

FIG. 3 is a flow diagram of method 150, another example vertical trajectory detection method that may be carried out by system 20. As with method 100, method 150 includes steps 102 and 104. As shown by FIG. 3, method 150 alternatively includes step 156 in place of step 106. In step 156, controller 40 adjusts the subsequent firing or ejection of liquid of one or more of nozzles 30 based upon the detected or determined vertical trajectory of the liquid droplets from such nozzles to accommodate any errors in such vertical trajectories. For example, it may be determined that a particular nozzle 30 has an errant vertical trajectory causing the liquid droplet to actually impinge a print medium or substrate at a location offset from an intended or target position. To accommodate such an errant vertical trajectory, controller 40 may adjust the timing at which liquid droplets are ejected from the particular nozzle 30 in relationship to movement of the print medium or substrate below the printed 24 such that the actual impingement location for liquid droplet once again coincides or nearly coincides with the original intended or target location or will fire a neighboring nozzle to substitute for the misfiring nozzle or not fire it at all if that were to keep the image quality higher FIG. 4 schematically illustrates printing system 222, an example implementation of printing system 22 shown in FIG. 1. Printing system 222 comprises media transport 223 and print head 224. Media transport 223 comprises one or more mechanisms that move a print medium or print substrate in a direction as indicated by arrow 252 beneath and with respect to print head 224. In one implementation, media transport 223 comprises one or more belts, rollers and the like which contact and drive a sheet or web of a print medium beneath or opposite to print head 224. In another implementation, media transport 223 may comprise a rotatable drum carrying a sheet or supporting a web of print medium. The print media may comprise a cellulose-based material or may comprise other structures upon which an image or pattern of liquid droplets are to be deposited.

Print head 224 comprise a structure for delivering liquid, such as ink, to nozzles 30 (described above). In the example implementation illustrated, print head 224 comprises liquid delivering slots 225A, 225B, 225C and 225D (collectively referred to as slots 225) which receive different liquids, such as different colors of ink, from different liquid reservoirs (on-axis or off-axis ink supplies) and which supply such different liquids (such as different colors of ink) to columns 226A, 226B, 227A, 227B, 228A, 228B, and 229A, 229B of nozzles 30. In the example illustrated, slot 225A supplies magenta colored ink to nozzles 30 in each of columns 226A and 226B. Slot 225B delivers yellow colored ink to nozzles 30 in each of columns 227A and 227B. Slot 225C delivers cyan colored ink to nozzles 30 in each of columns 228A and 228B. Slot 226D delivers black colored ink to nozzles 30 in each of columns 229A and 229B. The different colors of ink provided by slots 225 and their associated nozzles 30 facilitate the forming of multiple colored images upon a print medium being driven by media transport 223. In other implementations, the colors of inks provided by slots 225 may be varied.

Similar to printing system 22, printing system 222 additionally comprises liquid drop vertical trajectory error detection system 220. System 220 is similar to system 20 in that system 220 comprises a light source 234, lens 236, sensor 238 and controller 240 which reads instructions contained in a non-transient computer-readable medium provided by memory 250. Light source 234, lens 236, sensor 238, controller 240 and memory 250 are substantial identical to light source 34, lens 36, sensor 38, controller 40 and memory 50, respectively, described above, except that such components are specifically configured to sense or detect vertical trajectories of ink droplets of different colors ejected from a nozzle 30 adjacent to each of slots 225 using a single focal state. In one implementation, system 220 detects a vertical trajectory of ink droplets which are concurrently ejected from nozzles 30 contained in multiple distinct columns along the multiple slots 225. In one implementation, system 220 determines or detects a vertical trajectory of ink droplets ejected from a nozzle 30 in each of two columns along each of slots 225 using a same or single focal state. In one implementation, system 220 determined to detects a vertical trajectory of ink droplets concurrently ejected from a nozzle 30 in each of two columns along each of slots 225. As a result, ink trajectory error detection and possible compensation may be achieved with fewer, if any, refocusing of lens 236 and/or sensor 238 and/or fewer passes along the print head of the detection carriage, that is used to scan the print head. Consequently, such multiplexed error detection may be achieved using a simpler and less complex system 220 and may be achieved in less time thus e faster detection may be achieved by concurrently firing or ejecting ink from such nozzles.

Figure 5:
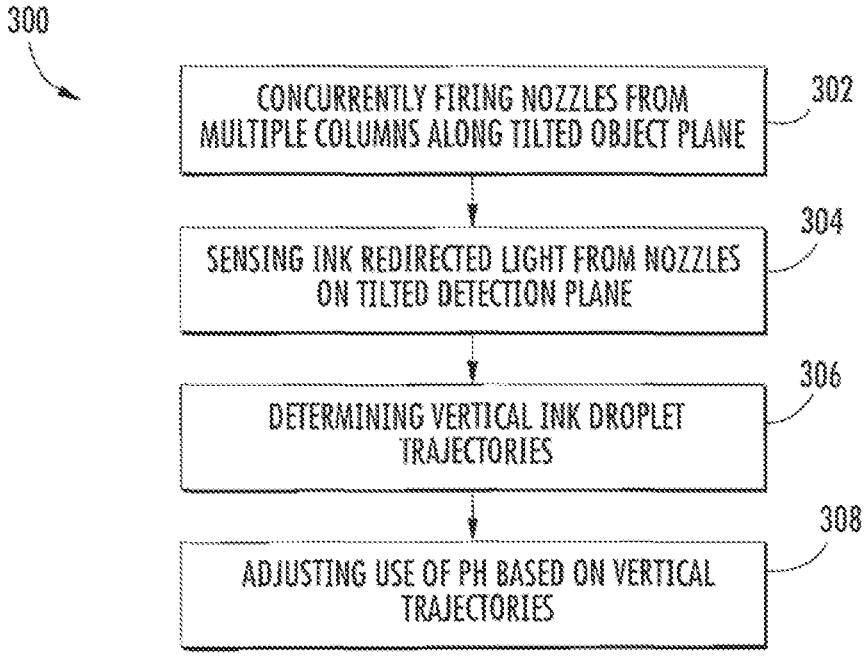
FIG. 5 is a flow diagram of an example method that may be carried out by the printing system of FIG. 4.

FIG. 5 is a flow diagram illustrating an example method 300 which may be carried out by controller 240 following instructions contained in memory 250. As indicated by step 302, controller 240, following instructions contained in the computer readable code in the non-transient computer-readable medium of memory 250, generates nozzle firing signals which resulted in a nozzle 30 in each of nozzle columns 226A, 226B, 227A, 227B, 228A, 228B, 229A and 229B along object plane 244 to fire or eject a liquid droplet, wherein light is reflected or otherwise redirected by such ejected ink droplets and is subsequently sensed by sensor 238 with a single focal state for lens 236 and sensor 238. As indicated by step 302 in FIG. 5, in one example implementation, liquid droplets are concurrently ejected from such nozzles along the tilted object plane 244.

As indicated by step 304, and as schematically shown by the light rays 251 in FIG. 4, the light that is reflected or otherwise redirected from the liquid or ink droplets along tilted object plane 244 is focused by lens 236 onto the tilted image or detection plane 248 of sensor 238. Because the nozzles from which the drop is ejected substantially lie along the tilted object plane 244, because image or detection plane 248 is also tilted with respect to the axes of the columns of nozzles 30 and because such tilting is arranged to operate according to the Scheimpflug principal, sensing system 220 has a larger depth of field such that vertical trajectories of ink droplets from nozzles across multiple nozzle columns and across multiple slots 225 may be detected using a single focal state and, in one implementation, detected from a single concurrent firing at each of such nozzles in the different columns of nozzles.

As indicated by step 306 and FIG. 5, based upon the impingement of the reflected, scattered or redirected light onto imager detection plane 248 of sensor 238, controller 240 determines a vertical ink droplet trajectory of each of such nozzles 30. As indicated by step 308, the detected vertical ink droplet trajectory is used by controller 240 to adjust subsequent use of print head 224. In particular, controller 40 adjusts the subsequent firing or ejection of liquid of one or more of nozzles 30 based upon the detected or determined vertical trajectory of the liquid droplets from such nozzles to accommodate any errors in such vertical trajectories. For example, it may be determined that a particular nozzle 30 has an errant vertical trajectory causing the liquid droplet to actually impinge a print medium or substrate at a location offset from an intended or target position. To accommodate such an errant vertical trajectory, controller 240 may adjust the timing at which liquid droplets are ejected from the particular nozzle 30 in relationship to movement of the print medium or substrate below the print head 224 such that the actual impingement location for liquid droplet once again coincides or nearly coincides with the original intended or target location or a neighboring nozzle firing pattern may be instituted to compensate when the print head does not move.

Figure 6:
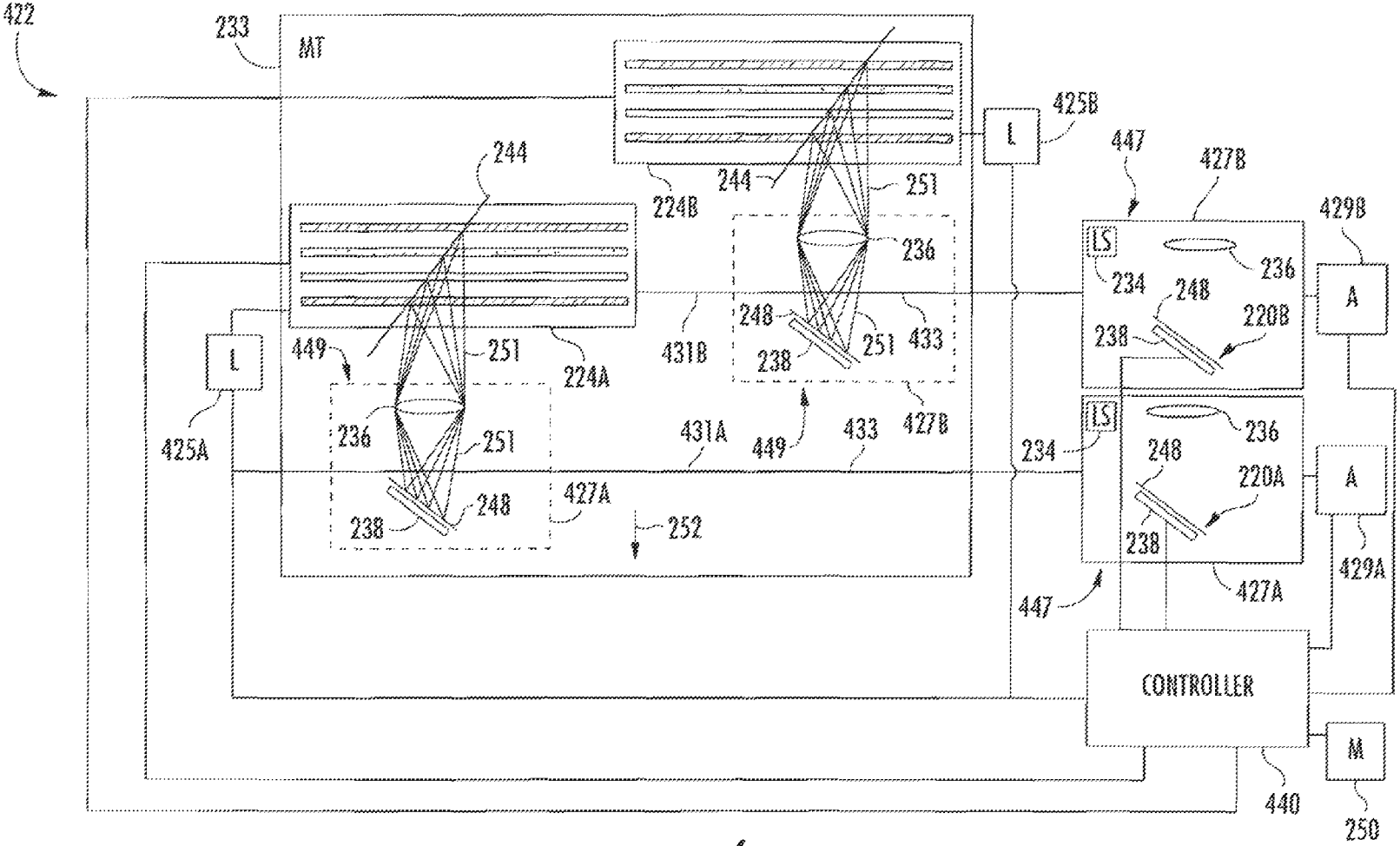
FIG. 6 is a schematic illustration of another example printing system including example nozzle ejection trajectory detection systems.

FIG. 6 schematically illustrates printing system 422, another example implementation of printing system 222. Printing system 422 comprises media transport 233, print heads 224A, 224B, print head lifters 425A, 425B (collectively referred to as lifters 425), carriages 427A, 427B (collectively referred to as carriages 427), actuators 429A, 429B (collectively referred to as actuators 429) and droplet vertical trajectory detection systems 220A, 220B. Media transport 233 is described above with respect to printing system 222. Print heads 224A and 224B are each identical to print head 221 described above with respect to printing system 222. As shown in FIG. 6, print heads 224A and 224B are staggered with respect to one another so as to partially overlap one another and so as to collectively span a width of a print medium to be printed upon. In the example implementation, print head 224A and print head 224B collectively span a width of media transport 233 in a direction substantially perpendicular to the direction of media travel as indicated by arrow 252. Because print heads 224A and 224B collectively span a width of a medium to be printed upon, print heads 224A and 224B may be supported in a horizontal stationary manner in what is sometimes referred to as a page-wide-array printing arrangement to facilitate full-width printing one pass and quicker full page printing with paper feed (the print head does not have to be scanned, one full width of the page is printed at one time so it shortens the overall print time.

Lifters 425A and 425B (collectively referred to as lifters 425) comprise devices or mechanisms configured to vertically lift or raise print heads 424A and 424B, respectively. Lifters 425 move print heads 421A and 424B between a lowered position closer to a print medium for printing and a raised position farther above media transport 233, raised above media transport 233 by a distance such that detection systems 220 supported by carriages 427A and 427B may direct light from light sources 231 between a lower face of print heads 224 and media transport 233 and such that redirected light from ejected liquid droplets may be focused on to sensors 238 by lenses 236. In one implementation, lifters 425 comprise electrical solenoids. In other implementations, lifters 425 may comprise other mechanical actuators coupled to print heads 224 to raise and lower print heads 224.

Carriages 427 comprise platforms or beds that are selectively movable with respect to media transport 233 and with respect to printed 224 along axes 431A and 431B, respectively. In one implementation, carriages 427 are slidably supported along guide rods 433 (schematically shown). In other implementations, carriages 427 may be movably supported in other fashions. Carriages 427A and 427B carry and support vertical trajectory error detection systems 220A and 220B, respectively.

Actuators 429 comprise mechanisms to linearly move or drive carriages 427 and the associated vertical trajectory detection systems 220 along axes 431 to appropriately position systems 220 for detecting or measuring vertical trajectories of liquid or ink droplets of nozzles 30 of print heads 224. In one implementation, each of actuators 429 may comprise a motor and belt arrangement, wherein a belt, attached to an associated one of carriages 427, is driven back and forth by a motor, such as a stepper motor or servomotor. In other implementations, each of actuators 429 may comprise other mechanisms for linearly moving or driving carriages 427. Although system 422 is illustrated as including two independently movable and independently drivable carriages 427, in other implementations, system 42 may include a single carriage 427 and a single actuator 429, wherein a single carriage 427 carries and supports a staggered pair of detection systems 220 for detecting the vertical trajectory of liquid droplets ejected from nozzles of different columns of each of print heads 224A and 224B.

Vertical trajectory detection systems 220 are each identical to system 220 shown and described above with respect to printing system 220 except that the two systems 220A and 220B are controlled by a shared controller 440 and lieu of individual controllers. Controller 440 operates according to instruction contained a memory 250 so as to detect a vertical trajectory of liquid droplets ejected from nozzles of multiple different nozzle columns using a single focal state or where such liquid droplets are concurrently ejected as described above with respect to system 220. Those components of each detection system 220A and 220B which correspond to detection system 220 shown in FIG. 4 are numbered similarly. Although printing system 422 is illustrated as including two staggered print heads 224 that collectively span a print medium along with an associated two carriages 427, two actuators 429 and two detection systems 220, in other implementations, printing system 422 may include greater than two print heads 224 that collectively span a print medium and greater than two carriages 47, actuators 429 and detection systems 220.

In operation, during a servicing phase, an initial setup phase or a calibration phase, controller 440, following instructions contained in memory 250, generates control signals causing lifters to lift or raise print heads 224 to the raised positions. Thereafter, controller 440 generates control signals causing actuators so as to move carriages 427 from the printing positions 447 (shown in solid lines) to the detection positions 449 (shown in broken lines). Once sensing systems 220 are properly positioned, controller 440 generate control signals causing the ejection or firing of liquid or ink droplets from nozzles 30 in two or more nozzle columns situated along an associated one of object planes 244. Such firing from the nozzles of different columns of a print head may occur without any intervening adjustment or refocusing of systems 220. In one implementation, such firing from the nozzles of different columns of a print head may occur concurrently. As schematically indicated by light rays 251, each lens 236 focuses droplet redirected light (infrared in one implementation) onto the tilted detection or image plane 248 of sensor 238. Controller 440 receives signals from sensors 238 and determines a vertical trajectory of liquid droplets ejected by or from the particular set of nozzles 30 along the object plane 244 of each of print heads 224.

After the vertical trajectory of liquid droplets for each of the nozzles of their particular set of nozzles from different columns and lying along object by 244 have been determined or are in process of being determined, controller 440 generate control signals directing actuators 429 to reposition carriages 427 for detecting another set of nozzles 30 which are located in multiple nozzle columns of each of print heads 224 and which lie upon a different tilted object plane 424. The above process is then repeated for the next set of nozzles 30. This process may be repeated until vertical trajectories of liquid droplets from a substantial portion, if not all, of the nozzles 30 of each of print heads 424 have been determined by controller 440.

In one implementation, actuators 429 continuously drive or continuously move the carriages 427 (or the single carriage 427 carrying both detection systems) across a length of the corresponding print heads. As a result, vertical trajectories of multiple nozzles may be more quickly determined. When determining the vertical trajectories, controller 440 takes into account the motion of the carriage and detection systems. In particular, controller may consult a look up table or apply a formula to determine a tilt of the droplet that will result solely from movement of the carriage at a given velocity (a motion induced trajectory). Any identified tilt beyond the motion induced trajectory may be deemed by controller 440 to be the result of vertical trajectory error (the tilt to the trajectory of the droplet that would occur absent carriage motion).

In such implementations where carriage 427 is continuously moved during the detection of vertical trajectories of nozzles 30, carriage 427 is driven at a speed to reduce the likelihood that ejected droplets produce overlapping spots on detection plane 48 of sensor 38. At the same time, depending upon the mechanical characteristics (such as gearing) of the actuator driving the carriage 427, carriage 427 should also be driven at a selected speed so as to reduce noise that might be caused by such factors as mechanical vibration. In one implementation, carriage 427 (or a single carriage 427 carrying both detection systems) is continuously moved relative to nozzles 30 at a rate or velocity of between 0 in./s and 6 in./s, and nominally within a range of 2 in./s and 3 in./s. In other implementations, the detection system may be continuously driven relative to the nozzles 30 at other velocities.

After the vertical trajectories of a desired number of nozzles has been determined by controller 440, controller 440 generates control signals causing actuators 429 to withdraw carriages 427 from media transport 233 to positions 447. Controller 440 also generates control signals causing lifters 4252 lower print heads 424 to the printing positions, closer to media transfer 233. Once print heads 44 have been lowered to printing positions, controller 440 may generate control signals, according to instructions read from memory 250 and according to a digital image or pattern to be printed, causing media transfer 233 to move and position a print medium or substrate opposite to print head 224 and to cause nozzles 30 to selectively eject liquid droplets onto the print medium. Based upon the determined vertical trajectories of liquid droplets from particular nozzles, controller 440 may adjust the timing at which the medium is driven or moved by media transfer 233 and the timing at which liquid droplets are fired or ejected from particular nozzles 30 to compensate for any detected vertical trajectory errors previously identified and stored in memory 250.

Figure 7:
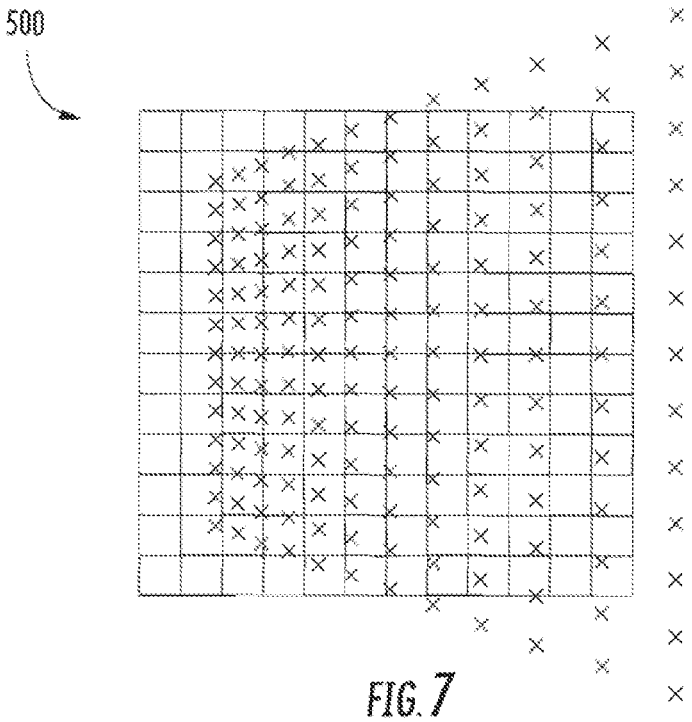
FIG. 7 is a diagram illustrating a pattern of optical distortions at maker with the nozzle ejection trajectory detection system of FIG. 1.

FIG. 7 illustrates an example pattern 500 of distortion that may result from the tilting of object plane 44 and image plane 48. In particular, if a rectangular array of imaginary points in the object plane 44 were imaged to the detector plane or image plane of the sensor, there would be a distortion pattern as shown in FIG. 7 of the grid points. It is important to note that the rectangular grid of points is actually on plane 248 of FIG. 6 or into the page as a view is looking at that figure. The ejected ink drop path will be along the vertical directions of the FIG. 7 when there is no motion of the detection sensor. Thus each visible ink path after being ejected from a nozzle location 30 along the object field will appear as a straight line in the image plane but they will be closer together the farther out on the object plane that the nozzle ejection took place. This distortion must be taken into account no as to identify a suitable nozzle firing pattern so the ink drop paths don't overlap.

Figure 8:
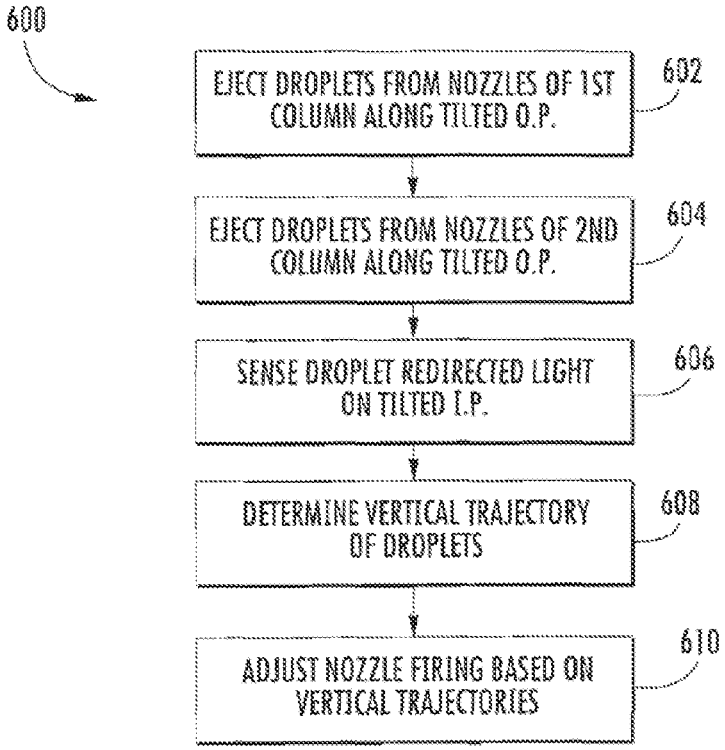
FIG. 8 is a flow diagram of an example method for detecting multiple nozzles in each of multiple columns that may be carried out by the system of FIG. 4.
Figure 9:
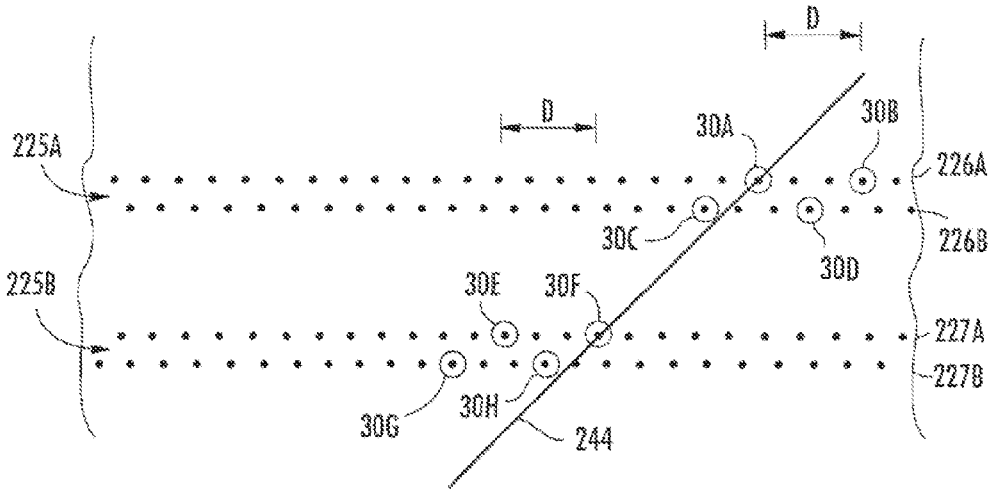
FIG. 9 is a schematic illustration of a portion of the printing system of FIG. 4 during carrying out of the method of FIG. 8.

FIG. 8 is a flow diagram illustrating an example method 604 that may be carried out by systems 222 for determining or detecting vertical trajectories of multiple nozzles in a first column and multiple nozzles in a second column of a print head while in a single focal state, taking into account the distortion phenomena exemplified in FIG. 7. Although the method 604 is described with respect to system 222, method 604 may also be carried out by systems 22 and 422 or other printing systems. FIG. 9 is a schematic illustration of a portion of print head 224 of printing system 222 illustrating an example set of nozzles for which vertical trajectories may be determined while system 220 is at a single position and in a single focal state. As shown by FIG. 9, the vertical trajectories of droplets ejected from multiple nozzles from each of the different columns are detected in the single focal state of system 220. In one implementation, the vertical trajectories of droplets concurrently ejected from multiple nozzles from each of the different columns are detected.

As indicated by step 602 in FIG. 8, liquid droplets or ink droplets are ejected from nozzles 30 located in a first column at a first spacing along a tilted object plane 244. An example of step 602 is shown in FIG. 9, wherein those nozzles from which liquid droplets are ejected during a single focal state, and nominally concurrently, are circled. In particular, controller 240 generates control signals causing liquid droplets to be ejected from nozzles 30A and 30B along column 226A, wherein nozzle 30B is spaced from nozzle 30A (the nozzle closest to object plane 244) by D. Controller 240 generates control signals causing liquid droplets to be ejected from nozzles 30C and 30E along column 226B, wherein nozzle 30D is spaced from nozzle 30C (the nozzle closest to object plane 244) by distance D. Controller 240 provides the spacing or distance D between those nozzles that are being detected along a single columns to reduce a likelihood that the distortion that may result from such tilted planes (as exemplified in FIG. 7) will result in overlapping of the spots of light that impinge sensor 238. The spacing D takes into account the spacing of the nozzle columns from lens 220 as well the speed at which detection systems 447 are moved (for continuous scanning) so as to be large enough to accommodate additional distortion that may be experienced with those nozzles that are farthest away from lens 236 and sensor 238. The pattern of skipping nozzles 30 between nozzles 30 of a column facilitates reliable vertical trajectory detection from multiple nozzles along a single column.

As indicated by step 604 in FIG. 8, Controller 245 utilizes the same skipping pattern and spacing for those nozzles 30E, 30F, 30G and 30H along columns 227A and 227B. As shown by FIG. 9, the particular skipping pattern ejects ink or liquid from nozzles 30 symmetrically located about object plane 244 with the spaced extra nozzles 30B and 30D along a first slot 225A lying on a first side of object plane 244 and with the spaced extra nozzles 30E and 30G line on a second side of object plane 244.

As noted above, because system 222 detects the vertical trajectories of ink droplets ejected from nozzle along a tilted object plane 244 and because lens 236 focuses the redirected light from such droplets onto a tilted imager detection plane 248 (shown in FIG. 4), system 220 has a larger depth of field, facilitating detection of vertical trajectories of ink droplets from multiple nozzles in each of multiple columns in a single focal state, without having to adjust the focusing lens 236 or the operation of sensor 238 (shown in FIG. 4). In one implementation, such vertical trajectory detection may be made from all of such nozzles concurrently as such nozzles are fired concurrently with one another.

Although FIG. 9 illustrates four columns 226A, 226B, 227A and 227B along two slots 225, similar skip patterns may be utilized to detect vertical trajectories of multiple nozzles in other columns. For example, the vertical trajectories of liquid droplets from multiple columns along slots 225C and 225D (shown in FIG. 4) may also be detected using the same focal state as used during the detection of the nozzles 30 along columns 225A and 225B, wherein the spacing between the nozzles for which vertical trajectories are being determined is even larger as such nozzles 30 are spaced even farther from lens 236. It should be noted that the illustrated skipping of two nozzles 30 for those columns along slot 225A and two nozzles 30 for those columns along slot 225B is merely exemplary. In other implementations, other skipping patterns and other spacings may be utilized depending upon the particular distortion characteristics given the particular tilting of object plane 244 and the image plane 248 of sensor 238.

As indicated by step 606 in FIG. 8, during the ejection of liquid droplets or ink droplets from the selected nozzles in different columns along object plane 244, light is directed at such nozzles such that the light is scattered, reflected or otherwise redirected towards lens 236 which focuses the redirected light onto the tilted image plane 248 of sensor 238 (shown in FIG. 4). As a result, sensor 238 senses the droplet redirected light. As indicated by step 608 in FIG. 8, controller 240 receives signals representing the detected redirected light and determines a vertical trajectory of the droplets ejected from such nozzles 30. As indicated by step 610, controller 240 adjusts subsequent nozzle firing or the subsequent driving of media by media transfer 223 (shown in FIG. 4) based upon the determined vertical trajectories. In particular, controller 240 may adjust the timing at which the medium is driven or moved by media transport 223 and the timing at which liquid droplets are fired or ejected from particular nozzles 30 to compensate for any detected vertical trajectory errors previously identified and stored in memory 250.

Figure 10:
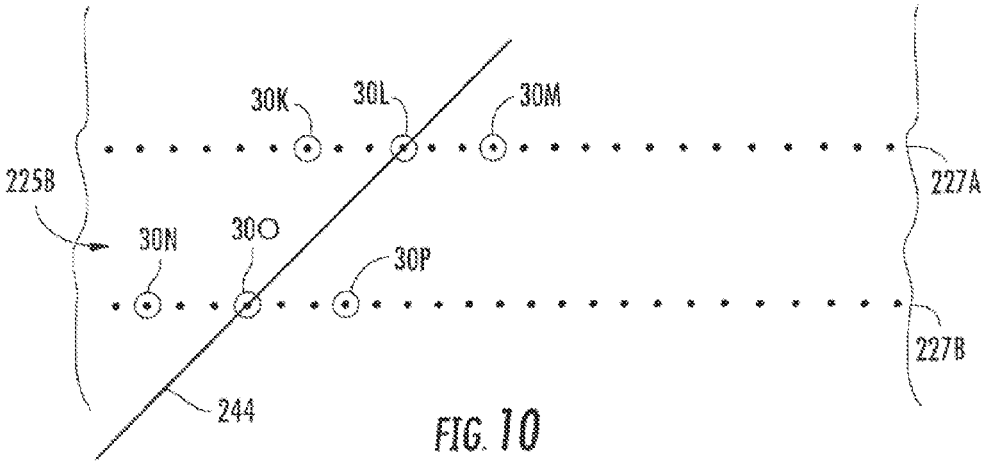
FIG. 10 is a schematic illustration of a portion of the printing system of FIG. 4 illustrating another example skipping pattern that may be utilized with the method of FIG. 8.

FIG. 10 is a schematic illustration of a portion of print head 224 of printing system 222 illustrating another example set of nozzles for which vertical trajectories may be determined while system 220 is at a single position and in a single focal state. FIG. 10 illustrates nozzles 30 of columns 227A and 227B along a single slot 225B (for ejecting a single color of ink). As indicated by circles in FIG. 10, nozzles 30K 30L, and 30M along column 227A are fired at the same time (or while system 220 is in a single focal state) as nozzles 30N, 30O and 30P of column 227B. In the example illustrated, nozzles 30L and 30O lie closest to object plane 244 with nozzles 30K and 30M being spaced from nozzle 30L by two nozzles on either side of nozzle 30L and with nozzle 30N and 30P being spaced by two nozzles from nozzle 30O on either side of nozzle 30O. In other implementations, other skipping or spacing patterns may be utilized.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a lens to focus light reflected from liquid droplets ejected from a plurality of columns of nozzles, the lens having an object plane, which is the lens' plane of focus, that is tilted at an oblique angle with respect to a print media travel direction and longitudinal axes of the columns of nozzles;

a sensor, optically coupled to the lens, to receive the light reflected from the liquid droplets; and a controller to:

generate control signals to concurrently fire two nozzles from different columns, the nozzles fired being arranged along the object plane such that the lens, having a plane of focus at the object plane, forms, on the sensor, two separate spots of light reflected by the liquid droplets from the fired nozzles;

receive signals from the sensor so as to detect a trajectory of the liquid droplets ejected from the plurality of columns of nozzles based on the control signals; and identify a trajectory error.

2. The apparatus of claim 1, wherein the fired nozzles are both on the object plane when fired.

3. The apparatus of claim 1, wherein the fired nozzles are on opposite sides of the object plane when fired.

4. The apparatus of claim 1, wherein the plurality of columns comprises a first column of cyan ink ejecting nozzles, a first column of magenta ink ejecting nozzles, a first column of yellow ink ejecting nozzles and a first column of black ink ejecting nozzles.

5. The apparatus of claim 4 further comprising a second column of cyan ink ejecting nozzles, a second column of magenta ink ejecting nozzles, a second column of yellow ink ejecting nozzles and a second column of black ink ejecting nozzles.

6. The apparatus of claim 1, wherein the sensor comprises a two-dimensional array of sensing elements.

7. The apparatus of claim 1, wherein the sensor comprises two offset linear arrays of sensing elements.

8. The apparatus of claim 1, wherein the controller receives signals from the sensor based on impingement of the detection plane by the light from the plurality of the columns of nozzles while the lens and the sensor are in a single focal state.

9. The apparatus of claim 1, further comprising:

a carriage to carry the lens and the sensor; and an actuator to move the carriage under control of the controller.

10. The apparatus of claim 9, wherein the controller is to generate control signals causing the actuator to continuously move the carriage relative to the plurality of columns of nozzles while detecting a vertical trajectory of each of the nozzles, wherein the controller compares the detected vertical trajectory of each of the nozzles with a motion induced vertical trajectory to identify a vertical trajectory error for each of the nozzles.

11. The apparatus of claim 1, further comprising a light source to direct light toward the columns of nozzles in a direction less than 10 degrees offset from the object plane.

12. The apparatus of claim 1, the controller to fire the two nozzles at the same time.

13. The apparatus of claim 1, wherein the sensor comprises a first row of sensing elements spaced apart from a second row of sensing elements, the first row of sensing elements to sense upper portion of a trajectory of a liquid droplet and the second row of sensing elements to sense a lower portion of a trajectory of a liquid droplet.

14. The apparatus of claim 1, wherein the sensor comprises a density of sensing elements such that each spot of light formed by the lens on the sensor impinges at least two sensing elements.

15. The apparatus of claim 1, wherein the object plane is arranged at between 35 degrees and 55 degrees with respect to the longitudinal axes of the columns of nozzles.

16. The apparatus of claim 1, the controller to adjust a timing at which liquid droplets are ejected from a particular nozzle identified as having a trajectory error.

17. A method comprising:

simultaneously sensing light redirected by liquid droplets ejected from nozzles of a plurality of columns of nozzles of a print head while in a single focal state by using a lens to focus light reflected from the liquid droplets, the lens having an object plane, which is the lens' plane of focus, that is tilted at an oblique angle with respect to a print media travel direction and longitudinal axes of the columns of nozzles; a sensor, optically coupled to the lens, to receive the light reflected from the liquid droplets; and a controller to generate control signals to fire concurrently two nozzles from different columns, the nozzles fired being arranged along the object plane such that the lens, with a plane of focus at the object plane, forms, on the sensor, two separate spots of light reflected by the liquid droplets from the fired nozzles;

using output from the sensor, determining a vertical trajectory of the liquid droplets ejected from the nozzles in the plurality of columns;

comparing the determined vertical trajectory with a motion induced vertical trajectory to identify a vertical trajectory error; and performing one of repairing or discarding the print head or adjusting nozzle firing of the print head based on the vertical trajectory error.

18. The method of claim 17, wherein the two nozzles concurrently fired are directly on the object plane when fired.

19. The method of claim 17, wherein the two nozzles concurrently fired are on opposite sides of the object plane when fired.

20. An apparatus comprising:

a printer having print heads that collectively span a width of a print medium, each print head including a plurality of columns of nozzles;

a lens to focus light reflected from liquid droplets ejected from the plurality of columns of nozzles, the lens having an object plane, which is the lens' plane of focus, that is tilted at an oblique angle with respect to a print media travel direction and longitudinal axes of the columns nozzles;

a sensor, optically coupled to the lens, to receive the light reflected from the liquid droplets; and a controller to:

generate control signals to concurrently fire nozzles from different columns, the nozzles fired being arranged along the object plane such that the lens, having a plane of focus at the object plane, forms, on the sensor, two separate spots of light reflected by the liquid droplets from the fired nozzles;

receive signals from the sensor so as to detect a trajectory of the liquid droplets ejected from the plurality of columns of nozzles based on the control signals; and identify a trajectory error.

* * * * *